US008179041B2

(12) United States Patent
Yanagita et al.

(10) Patent No.: US 8,179,041 B2
(45) Date of Patent: May 15, 2012

(54) PLASMA DISPLAY PANEL

(75) Inventors: Hideaki Yanagita, Miyazaki (JP); Masahiro Watabe, Miyazaki (JP); Takahiko Kato, Hitachinaka (JP); Takashi Naito, Funabashi (JP)

(73) Assignees: Hitachi, Ltd., Tokyo (JP); Hitachi Plasma Display Limited, Miyazaki (JP)

( * ) Notice: Subject to any disclaimer, the term of this patent is extended or adjusted under 35 U.S.C. 154(b) by 0 days.

(21) Appl. No.: 12/863,679

(22) PCT Filed: Sep. 4, 2008

(86) PCT No.: PCT/JP2008/002447

§ 371 (c)(1),
(2), (4) Date: Nov. 22, 2010

(87) PCT Pub. No.: WO2010/026619

PCT Pub. Date: Mar. 11, 2010

(65) Prior Publication Data

US 2011/0062865 A1 Mar. 17, 2011

(51) Int. Cl.
*H01J 1/62* (2006.01)

(52) U.S. Cl. ..... 313/582; 313/584

(58) Field of Classification Search ..... 313/582, 313/584, 586

See application file for complete search history.

(56) References Cited

U.S. PATENT DOCUMENTS 6,624,591 B2 * 9/2003 Mori et al. ..... 315/169.3
2005/0062422 A1 3/2005 Sasaki et al.

FOREIGN PATENT DOCUMENTS

| | | |
|---|---|---|
| JP | 09-022656 | 1/1997 |
| JP | 2005-116508 | 4/2005 |
| JP | 2006-134772 | 5/2006 |
| JP | 2008-153038 | 7/2008 |

* cited by examiner

*Primary Examiner* — Vip Patel

(74) *Attorney, Agent, or Firm* — McDermott Will & Emery LLP

(57) ABSTRACT

A plasma display panel (PDP) includes a first plate, and a second plate disposed to face the first plate via a discharge space and providing barrier ribs. A plurality of first electrodes and a plurality of second electrodes extending in a first direction, and a dielectric layer covering the first electrodes and the second electrodes are provided on the first plate. A plurality of address electrodes extending in a second direction, and a protective layer covering the dielectric layer and the address electrodes and exposing at least a part of the protective layer to the discharge space are provided on the dielectric layer. The address electrodes are made up by including a conductive layer formed by either one of aluminum and an alloy containing aluminum and copper and by not including a layer of a simple substance of copper.

5 Claims, 6 Drawing Sheets

PLASMA DISPLAY PANEL

RELATED APPLICATIONS

This application is the U.S. National Phase under 35 U.S.C. §371 of International Application No. PCT/JP2008/002447, filed on Sep. 4, 2008, the disclosures of which Applications are incorporated by reference herein.

TECHNICAL FIELD

The present invention relates to a plasma display panel used for a display device.

BACKGROUND ART

A plasma display panel (PDP) is made up by adhering two pieces of glass plates (a front glass plate and a back glass plate) with each other, and displays an image by generating discharge light in a space (discharge space) formed between the glass plates. Cells corresponding to pixels in the image are in a self-luminescence type and coated with phosphors emitting visible lights in red, green and blue by receiving ultraviolet ray generated by the discharge.

For example, a PDP in a three-electrode structure having X, Y electrodes and address electrodes displays images by generating a sustain discharge between the X electrodes and the Y electrodes. The cells generating the sustain discharge (cells to be lighted) are selected by, for example, selectively generating an address discharge between the Y electrodes and the address electrodes.

In a general PDP, the X electrodes and Y electrodes are disposed at the front glass plate, and the address electrodes are disposed at the back glass plate. In recent year, a PDP in which three electrodes of the X electrodes, Y electrodes, and address electrodes are disposed at the front glass plate has been proposed (for example, refer to Patent Document 1). The PDP having the three electrodes at the front glass plate generally has a first dielectric layer covering the X electrodes and the Y electrodes, and a second dielectric layer covering the address electrodes provided on the first dielectric layer. A protective layer protecting the dielectric layer from an ion collision resulting from discharge is provided on the second dielectric layer.

Patent Document 1: Japanese Unexamined Patent Application Publication No. 2005-116508

DISCLOSURE

Problems to be Solved

In a conventional PDP having three electrodes at a front glass plate, two layers of dielectric layers are formed on X electrodes and Y electrodes, and therefore, a manufacturing process to form the dielectric layers at the front glass plate increases. Namely, in the conventional PDP having the three electrodes at the front glass plate, a manufacturing cost of the front glass plate increases because the manufacturing process of the front glass plate increases.

A proposition of the present invention is to provide a PDP having three electrodes at a front glass plate while reducing a manufacturing cost. Besides, another proposition of the present invention is to improve reliability of the PDP while reducing the manufacturing cost in the PDP having the three electrodes at the front glass plate.

Means for Solving the Problems

A plasma display panel (PDP) has a first plate and a second plate disposed to face the first plate via a discharge space and providing barrier ribs. A plurality of first electrodes and a plurality of second electrodes extending in a first direction and disposed to have intervals with one another, and a dielectric layer covering the first electrodes and the second electrodes are provided on the first plate. A plurality of address electrodes extending in a second direction intersecting with the first direction and disposed to have intervals with one another, and a protective layer covering the dielectric layer and the address electrodes and at least a part thereof is exposed at the discharge space are provided on the dielectric layer. For example, the address electrodes are made up by including a conductive layer formed by either one of aluminum and an alloy containing aluminum and copper, and by not including a layer made of a simple substance of copper.

Effects

According to the present invention, it is possible to provide a PDP having three electrodes at a front glass plate while reducing a manufacturing cost. Besides, according to the present invention, it is possible to improve reliability of the PDP while reducing the manufacturing cost in the PDP having three electrodes at the front glass plate.

DETAILED DESCRIPTION OF THE EMBODIMENTS

Hereinafter, embodiments of the present invention are described by using the drawings.

Figure 1:
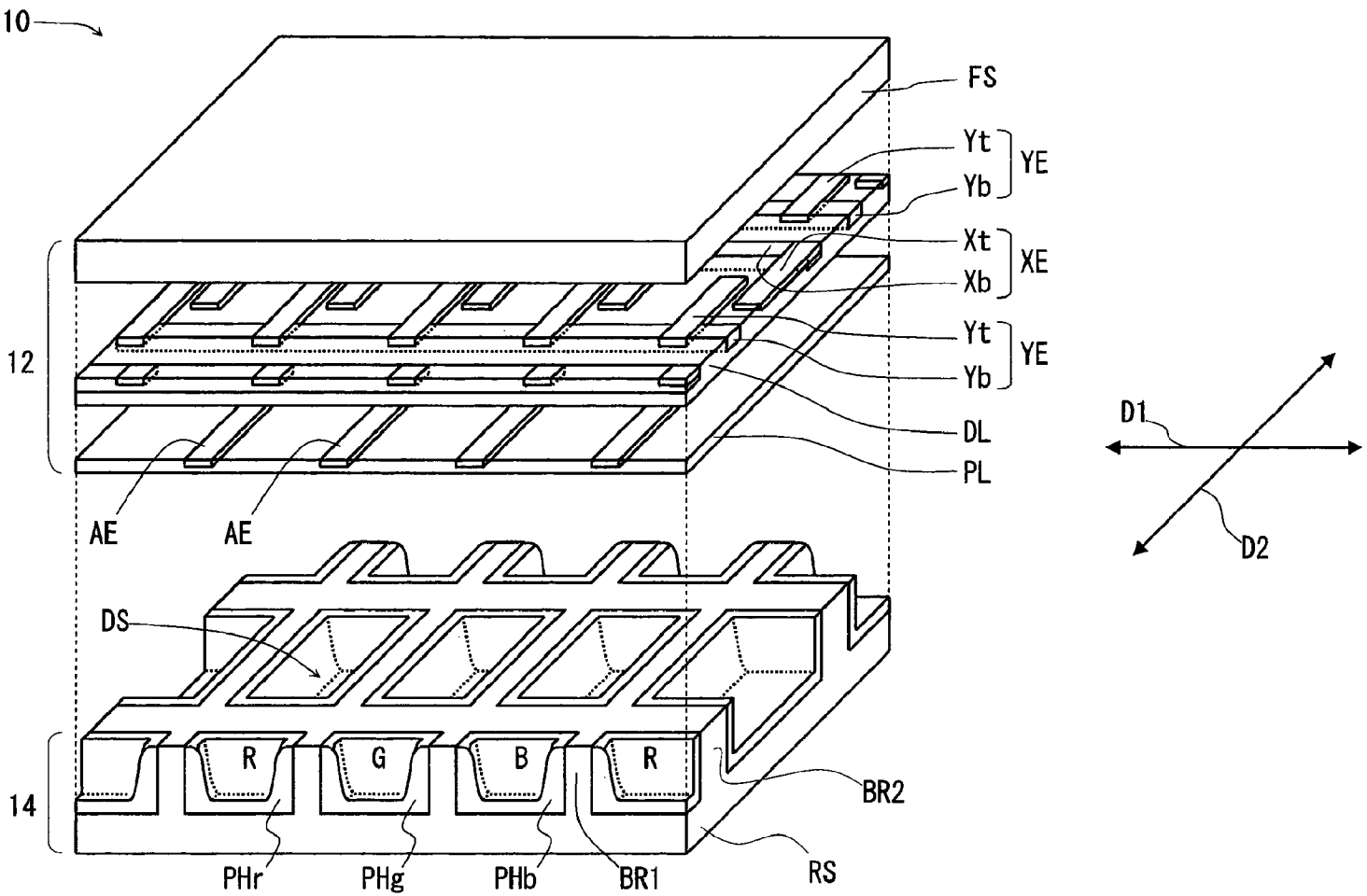
FIG. 1 is a view illustrating a substantial part of a PDP in an embodiment.

FIG. 1 illustrates a substantial part of a plasma display panel (hereinafter, called also as a PDP) in an embodiment. An arrow D1 in the drawing represents a first direction D1, and an arrow D2 represents a second direction D2 orthogonal to the first direction D1 within a surface in parallel with an image display surface. A PDP 10 is made up of a front plate part 12 making up the image display surface and a back plate part 14 facing the front plate part 12. A discharge space DS is formed between the front plate part 12 and the back plate part 14 (in more detail, at a dent part of the back plate part 14).

The front plate part 12 has X bus electrodes Xb and Y bus electrodes Yb formed in parallel along the first direction D1 and formed alternately along the second direction D2 on a glass base FS (first plate) (at a lower side in the drawing). Besides, X transparent electrodes Xt extending in the second direction D2 from the X bus electrodes Xb to the Y bus electrodes Yb are coupled to the X bus electrodes Xb. Y transparent electrodes Yt extending in the second direction D2 from the Y bus electrodes Yb to the X bus electrodes Xb are coupled to the Y bus electrodes Yb. In an example in the drawing, the X transparent electrode Xt and the Y transparent electrode Yt face along the second direction D2. Note that the transparent electrodes Xt, Yt may be provided to face along the first direction D1, and may be provided to face along a diagonal direction relative to the first direction D1 (or the second direction D2).

Here, the X bus electrode Xb and the Y bus electrode Yb are opaque electrodes formed by a metallic material and so on, and the X transparent electrode Xt and the Y transparent electrode Yt are transparent electrodes penetrating visible light formed by an ITO film and so on. An X electrode XE (first electrode, sustain electrode) is made up of the X bus electrode Xb and the X transparent electrode Xt, and a Y electrode YE (second electrode, scan electrode) is made up of the Y bus electrode Yb and the Y transparent electrode Yt. Discharge (sustain discharge) is repeatedly generated at an electrode pair made up of the X electrode XE and the Y electrode YE (more specifically, between the X transparent electrode Xt and the Y transparent electrode Yt).

Besides, the transparent electrodes Xt and Yt may be disposed on a whole surface between the bus electrodes Xb and Yb to which they are respectively coupled and the glass base FS. Note that electrodes which are made of the same material (metallic material and so on) as the bus electrodes Xb and Yb, and integrated with the bus electrodes Xb and Yb may be formed instead of the transparent electrodes Xt and Yt.

The electrodes Xb, Xt, Yb, Yt are covered by a dielectric layer DL. For example, the dielectric layer DL is an insulating film such as a silicon dioxide film formed by a CVD method. Plural address electrodes AE extending in an orthogonal direction (second direction D2) of the bus electrodes Xb, Yb are provided on the dielectric layer DL (at a lower side in the drawing). For example, the address electrode AE is made up by including either an alloy layer (hereinafter called also as a conductive layer) formed by containing aluminum and copper or an aluminum layer (hereinafter, called also as the conductive layer) and by not including a layer made of a simple substance of copper. In this embodiment, the address electrode AE is made up of a single-layer film of the conductive layer. Note that the conductive layer is either the alloy layer formed by containing aluminum and copper or the aluminum layer as described above.

As stated above, the PDP in this embodiment has three electrodes (electrodes XE, YE, AE) at the front plate part 12. The address electrodes AE and the dielectric layer DL are covered by a protective layer PL. The protective layer PL is exposed to the discharge space DS, and it protects the address electrodes AE and the dielectric layer DL from ion collision resulting from discharge. Namely, a second dielectric layer covering the address electrodes AE is not formed, but the protective layer PL is directly formed on the address electrodes AE and the first dielectric layer DL, in this embodiment. For example, the protective layer PL is formed by magnesium oxide (MgO) of which emission characteristic of secondary electrons resulting from collision of a positive ion is high to make the discharge easy to occur.

The back plate part 14 has a glass base RS (second plate) facing the glass base FS via the discharge space DS. A barrier rib in grid state made up of first barrier ribs BR1 extending in the second direction D2 and second barrier ribs BR2 extending in the first direction D1 is formed on the glass base RS (on a surface of the glass base RS facing the glass base FS). In this embodiment, the barrier ribs BR1, BR2 are the same material as the glass base RS, and integrally formed with the glass base RS. For example, the barrier ribs BR1, BR2 are integrally formed with the glass base RS by selectively removing a portion of the glass base RS where the discharge space DS is formed by a sand blast method and so on. Accordingly, it is possible to reduce a manufacturing cost of the PDP because, for example, a baking process to form the barrier ribs BR1, BR2 is not necessary.

Sidewalls of a cell are made up by the barrier ribs BR1, BR2. Phosphors PHr, PHg, PHb emitting visible lights in red (R), green (G), blue (B) exited by ultraviolet ray are respectively coated at side surfaces of the barrier ribs BR1, BR2 and on the glass base RS at a portion surrounded by the barrier ribs BR1, BR2. Hereinafter, the phosphors PHr, PHg, PHb are called also as a phosphor PH when they are not distinguished by each color of the visible lights and so on.

One pixel of the PDP 10 is made up of three cells emitting lights in red, green and blue. Here, one cell (one color pixel) is formed at an area surrounded by, for example, the barrier ribs BR1, BR2. As stated above, the PDP 10 is made up by disposing the cells in a matrix state, and by alternately arranging plural kinds of cells emitting lights of which colors are different from one another to display the image. A display line is made up of the cells formed along the bus electrodes Xb, Yb, though it is not illustrated in particular.

The PDP 10 is made up by adhering the front plate part 12 and the back plate part 14 so as to bring the protective layer PL into contact with the first barrier ribs BR1, and so on, and by encapsulating discharge gas such as Ne, Xe into the discharge space DS.

Figure 2:
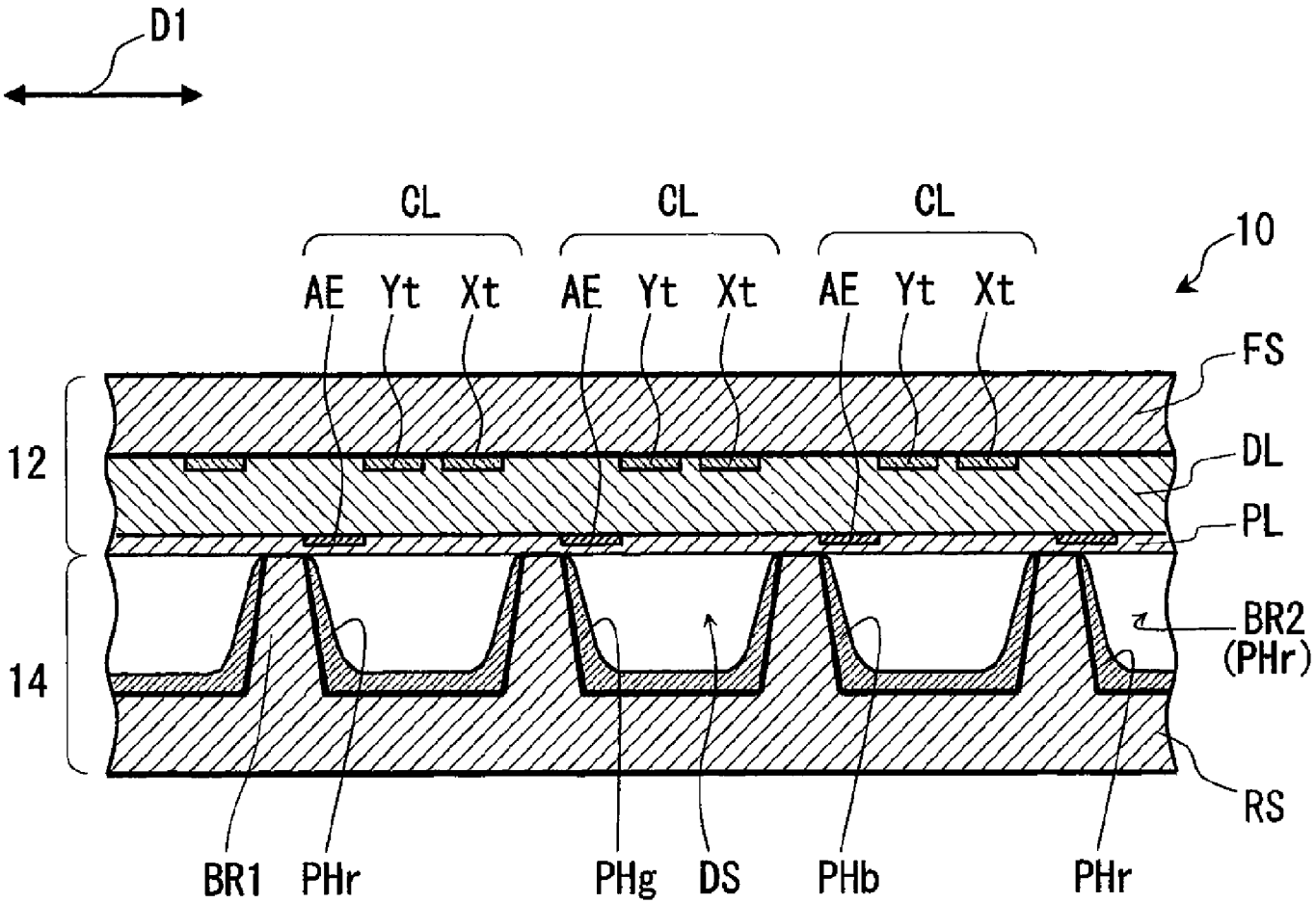
FIG. 2 is a view illustrating a cross section along a first direction of the PDP illustrated in FIG. 1.

FIG. 2 illustrates a cross section along the first direction D1 of the PDP 10 illustrated in FIG. 1. Note that FIG. 2 illustrates the cross section at a position where the X transparent electrode Xt and the Y transparent electrode Yt face each other (the cross section between the bus electrode Xb and the bus electrode Yb paired with each other). A meaning of the arrow D1 in the drawing is the same as the above-stated FIG. 1. Cells CL represent respective cells (cells emitting lights in red, green and blue) making up the pixels.

At least a part of the address electrode AE positions above the discharge space DS. Namely, at least a part of the address electrode AE is disposed in the cell CL. The transparent electrode Yt is disposed in each cell CL so as to be adjacent to the address electrode AE, and the transparent electrode Xt is disposed in each cell CL so as to be adjacent to the transparent electrode Yt. It is thereby possible to generate an address discharge at a focused cell CL by applying a voltage between the address electrode AE and the transparent electrode Yt. Besides, it is possible to generate the sustain discharge at a cell CL selected by the address discharge by applying a voltage between the transparent electrode Xt and the transparent electrode Yt.

Besides, the dielectric layer DL and the protective layer PL are formed between the transparent electrodes Xt, Yt and the discharge space DS, as it is described in the above-stated FIG. 1. In other words, the protective layer PL is provided to be in contact with the dielectric layer DL, to cover the dielectric layer DL and the address electrodes AE, and at least a part thereof is exposed to the discharge space DS. In this embodiment, the dielectric layer on the transparent electrodes Xt, Yt is only the one layer of the dielectric layer DL, and therefore, it is possible to reduce a manufacturing process compared to a PDP in which two layers of dielectric layers are formed on the transparent electrodes Xt, Yt.

Here, a constitution in which the protective layer PL is directly provided on the address electrode AE made up of a three-layer film layered in a sequence of chromium (Cr), copper (Cu) and chromium (Cr) is thought out in a process of the present invention. However, copper being a main constituent of the address electrode AE diffuses up to a surface of the protective layer PL (a surface at the discharge space DS side) resulting from a heat treatment being a process performed after the MgO protective layer PL is formed, and at least either one of copper or copper oxide is formed at the surface of the protective layer PL in this constitution. Here, processes performed after the protective layer PL is formed are, for example, a sealing process adhering the front plate part 12 and the back plate part 14, an exhaust process exhausting gas or the like generated from the phosphors PH, and so on.

The discharge becomes unstable and reliability of the PDP deteriorates under the constitution in which copper or copper oxide is formed at the surface of the protective layer PL. On the other hand, the address electrode AE is made up by not including the layer of the simple substance of copper in this embodiment, and therefore, copper or copper oxide is not formed at the surface of the protective layer PL. Accordingly, it is possible to improve the reliability of the PDP while reducing the manufacturing cost in this embodiment. Note that a relation between constituents of the address electrode AE and a state of the surface of the protective layer PL is described in later-described FIG. 3.

Figure 3:
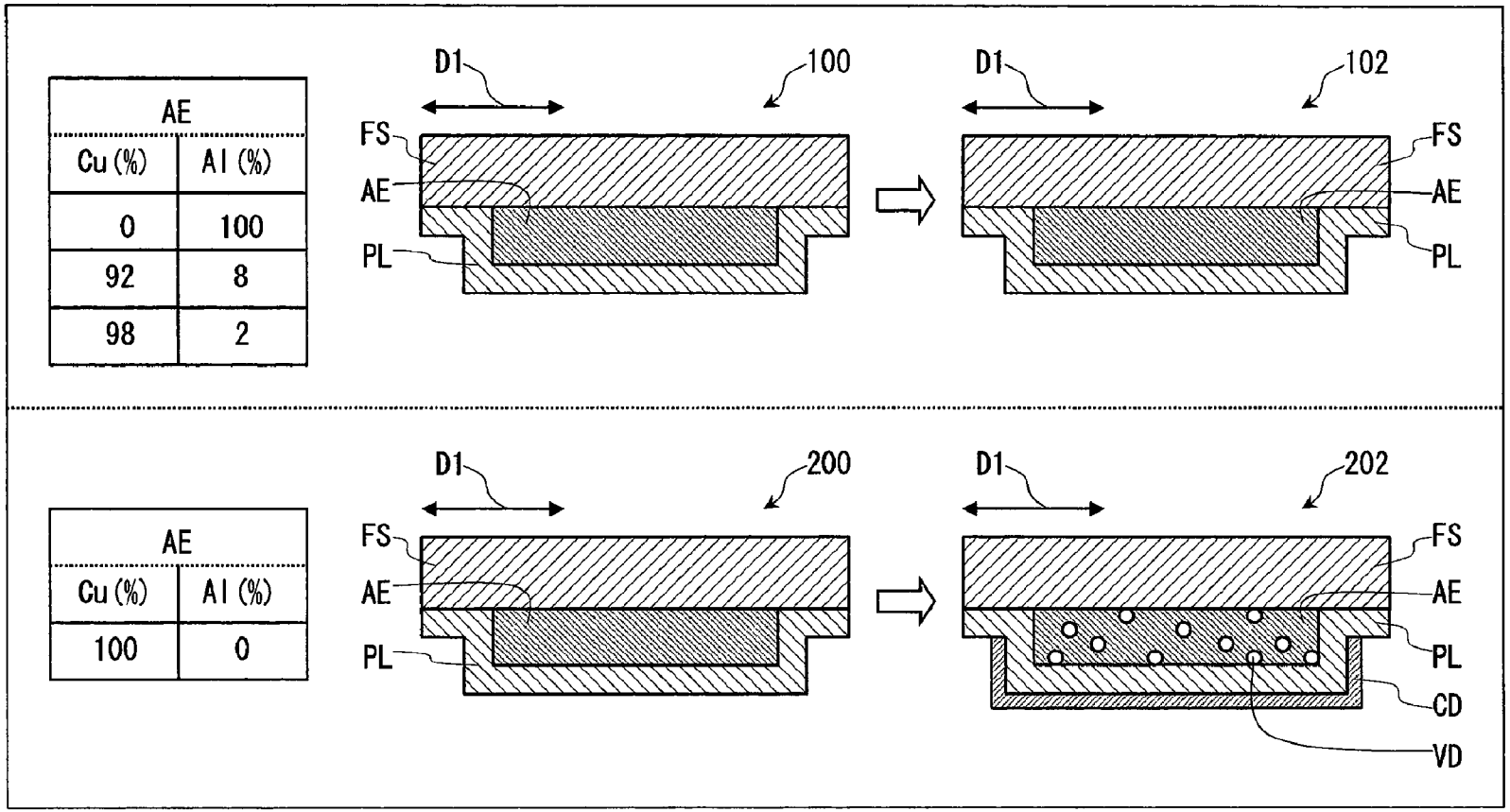
FIG. 3 is a view illustrating an example of a relation between constituents of an address electrode and a state of a surface of a protective layer.

FIG. 3 illustrates an example of the relation between the constituents of the address electrode AE and the state of the surface of the protective layer PL. Note that FIG. 3 illustrates a cross section of measurement plates 100, 102, 200, 202 along the first direction D1 before and after the heat treatment. The measurement plates 100, 200 before the heat treatment are made up by excluding the electrodes XE, YE and the dielectric layer DL from the front plate part 12 illustrated in the above-stated FIG. 1. The measurement plates 102, 202 are the plates after the heat treatment of the measurement plates 100, 200. A meaning of the arrow D1 in the drawing is the same as the above-stated FIG. 1. Besides, an upper view in the drawing represents measurement plates in which the address electrode AE is made up by not including the layer of the simple substance of copper, and a lower view in the drawing represents measurement plates of a comparative example in which the address electrode AE is made up of the layer of the simple substance of copper. A symbol "%" in the drawing represents a mass concentration of copper and aluminum relative to the address electrode AE.

The measurement plates 100, 200 before the heat treatment are made up by directly providing the address electrodes AE and the protective layer PL covering the address electrodes AE on the glass base FS. Note that the protective layer PL is formed by MgO. The measurement plates 102, 202 are respectively formed by performing the heat treatments (equivalent heat treatments with the sealing process and the exhaust process) supposed to be performed during the process from the protective layer PL is formed to the PDP is completed, to the measurement plates 100, 200, respectively.

There are three kinds of measurement plates 100 used for the experiment, which are a plate in which the address electrode AE is formed by a single-layer film of aluminum, a plate in which the address electrode AE is formed by a single-layer film of an alloy of 92% copper and 8% aluminum, and a plate in which the address electrode AE is formed by a single-layer film of an alloy of 98% copper and 2% aluminum. An error (for example, later-described deposit CD and voids VD of the address electrode AE) does not occur in the measurement plate 102 after the heat treatment even if the heat treatment is performed for the measurement plate 100.

On the other hand, in the measurement plate 202 being the plate after the heat treatment of the measurement plate 200 (the plate in which the address electrode AE is formed by the single-layer film of copper), copper in the address electrode AE diffuses resulting from the heat treatment, and the deposit CD of copper is formed at the surface of the protective layer PL. Here, the deposit CM is formed by containing at least either one of copper or copper oxide. Copper being the material of the address electrode AE moves (diffuses) to the surface of the protective layer PL, and therefore, the voids VD occur at the address electrode AE. In the PDP in which the voids VD occur at the address electrode AE, there is a possibility in which a drive of the PDP becomes unstable because wiring resistance of the address electrode AE increases. Besides, in the PDP in which the deposit CD is formed at the surface of the protective layer PL, the discharge becomes unstable, and the reliability of the PDP deteriorates.

On the other hand, it is possible to prevent that the deposit CM is formed at the surface of the protective layer PL of the plate after the heat treatment (measurement plate 102) in the constitution in which the address electrode AE is formed by the single-layer film (conductive layer) of the copper alloy containing aluminum of 2% or more or the single-layer film (conductive layer) of aluminum as stated above. Further, it is possible to prevent that the voids VD occur at the address electrode AE of the plate after the heat treatment (measurement plate 102) in the constitution in which the address electrode AE is formed by the single-layer film (conductive layer) of the copper alloy containing aluminum of 2% or more or the single-layer film (conductive layer) of aluminum.

Accordingly, in the PDP 10 illustrated in the above-stated FIG. 1, the conductive layer is formed by, for example, containing aluminum of 2% or more when the conductive layer of the address electrode AE is formed by the alloy containing aluminum and copper. Accordingly, it is possible to stably generate the discharge and to improve the reliability of the PDP in this embodiment. Further, it is possible to improve drive stability of the PDP in this embodiment.

Besides, it is also possible to improve the reliability of the PDP and the drive stability of the PDP as stated above when the conductive layer of the address electrode AE of the PDP 10 illustrated in FIG. 1 is formed by the single-layer film of aluminum. Note that it is possible to reduce the wiring resistance of the address electrode AE and to reduce a load when the PDP is driven in the constitution in which the conductive layer of the address electrode AE is formed by the single-layer film of the copper alloy containing aluminum compared to the constitution in which the conductive layer of the address electrode AE is formed by the single-layer film of aluminum.

Figure 4:
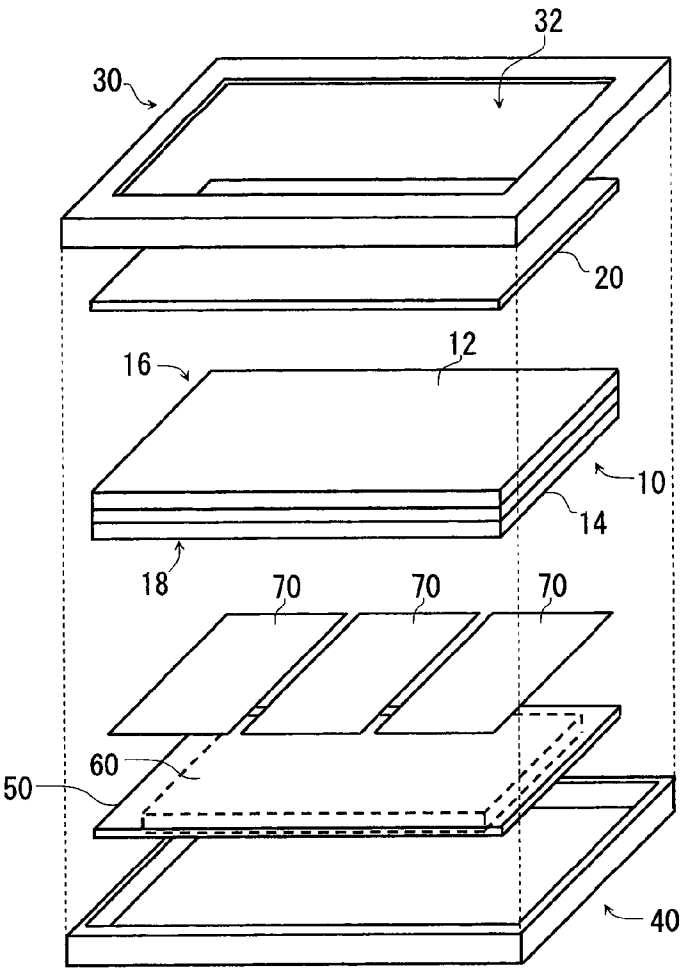
FIG. 4 is a view illustrating an example of a plasma display device made up by using the PDP illustrated in FIG. 1.

FIG. 4 illustrates an example of a plasma display device made up by using the PDP 10 illustrated in FIG. 1. The plasma display device (hereinafter, called also as a PDP device) has the PDP 10, an optical filter 20 provided at an image display surface 16 side (an output side of light) of the PDP 10, a front case 30 disposed at the image display surface 16 side of the PDP 10, a rear case 40 and a base chassis 50 disposed at a back surface 18 side of the PDP 10, a circuit unit 60 attached at the rear case 40 side of the base chassis 50 and to drive the PDP 10, and a double-faced adhesive sheet 70 to adhere the PDP 10 to the base chassis 50. The circuit unit 60 is made up of plural components, and therefore, it is represented by a dotted line box in the drawing.

The optical filter 20 is adhered to a protection glass (not-illustrated) attached to an opening part 32 of the front case 30. For example, the optical filter 20 has a function to lower a penetrable rate of the visible light so as to improve the contrast of the image of the PDP device. Note that the optical filter 20 may have a function to shield electromagnetic waves. Besides, the optical filter 20 may be adhered not to the protection glass but to the image display surface 16 side of the PDP 10 directly.

As stated above, the second dielectric layer covering the address electrodes AE is not formed, and the protective layer PL is directly formed on the address electrodes AE and the first dielectric layer DL in this embodiment. It is possible to reduce the manufacturing process because it is not necessary to form the two layers of dielectric layers in this embodiment. Further, the address electrode AE is made up by including the conductive layer formed by either the alloy containing aluminum and copper or aluminum, and by not including the layer of the simple substance of copper in this embodiment. It is thereby possible to generate the discharge stably and to improve the reliability of the PDP in this embodiment. Accordingly, it is possible to improve the reliability of the PDP while reducing the manufacturing cost in this embodiment. Namely, it is possible to provide the PDP having three electrodes (electrodes XE, YE, AE) at the front glass plate while reducing the manufacturing cost in this embodiment.

Note that the example in which one pixel is made up of three cells (red (R), green (G), blue (B)) is described in the above-stated embodiments. The present invention is not limited to the embodiments. For example, one pixel may be made up of four or more cells. Otherwise, one pixel may be made up of cells emitting colors other than red (R), green (G), blue (B), or one pixel may include a cell emitting a color other than red (R), green (G), blue (B).

The example in which the second direction D2 is orthogonal to the first direction D1 is described in the above-stated embodiments. The present invention is not limited to the embodiments. For example, the second direction D2 may intersect with the first direction D1 in approximately orthogonal direction (for example, 90 degrees±5 degrees). The similar effect as the above-stated embodiments can be obtained also in this case.

Figure 5:
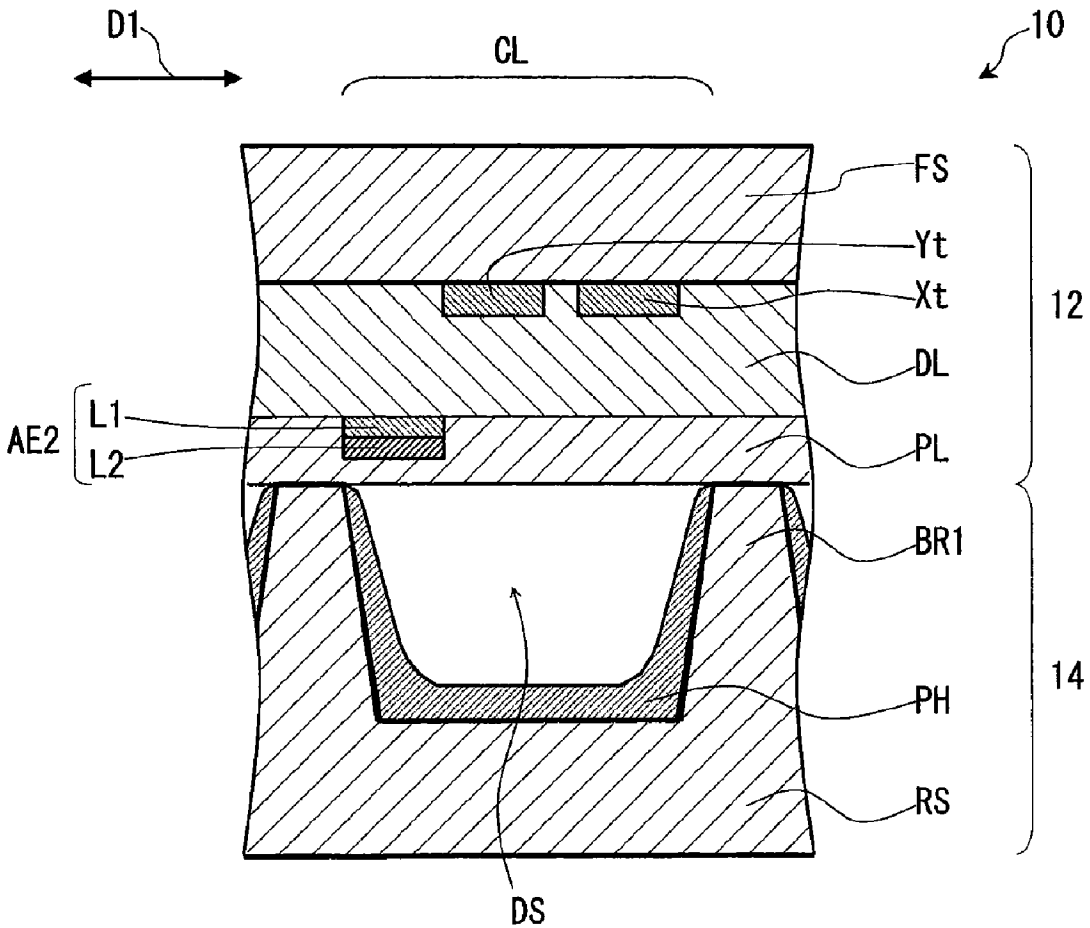
FIG. 5 is a view illustrating a modification example of the PDP illustrated in FIG. 1.

The example in which the address electrode AE is made up of the single-layer film of the conductive layer is described in the above-stated embodiment. The present invention is not limited to the embodiments. For example, an address electrode AE2 may be made up of a two-layer film layered in a sequence of a chromium layer L1 and a conductive layer L2 on the dielectric layer DL (a lower side in FIG. 5) as illustrated in FIG. 5. The address electrode AE2 is provided instead of the address electrode AE illustrated in the above-stated FIG. 1 in the PDP 10 illustrated in FIG. 5. The other constitution is the same as the above-stated embodiments. Note that the phosphor PH illustrated in the drawing is any one of the phosphors PHr, PHg, PHb. The similar effect as the above-stated embodiments can be obtained also in this case. Besides, for example, the address electrode AE may be made up of a three-layer film of chromium, the conductive layer and chromium layered in this sequence on the dielectric layer DL. The similar effect as the above-stated embodiments can be obtained also in this case.

Figure 6:
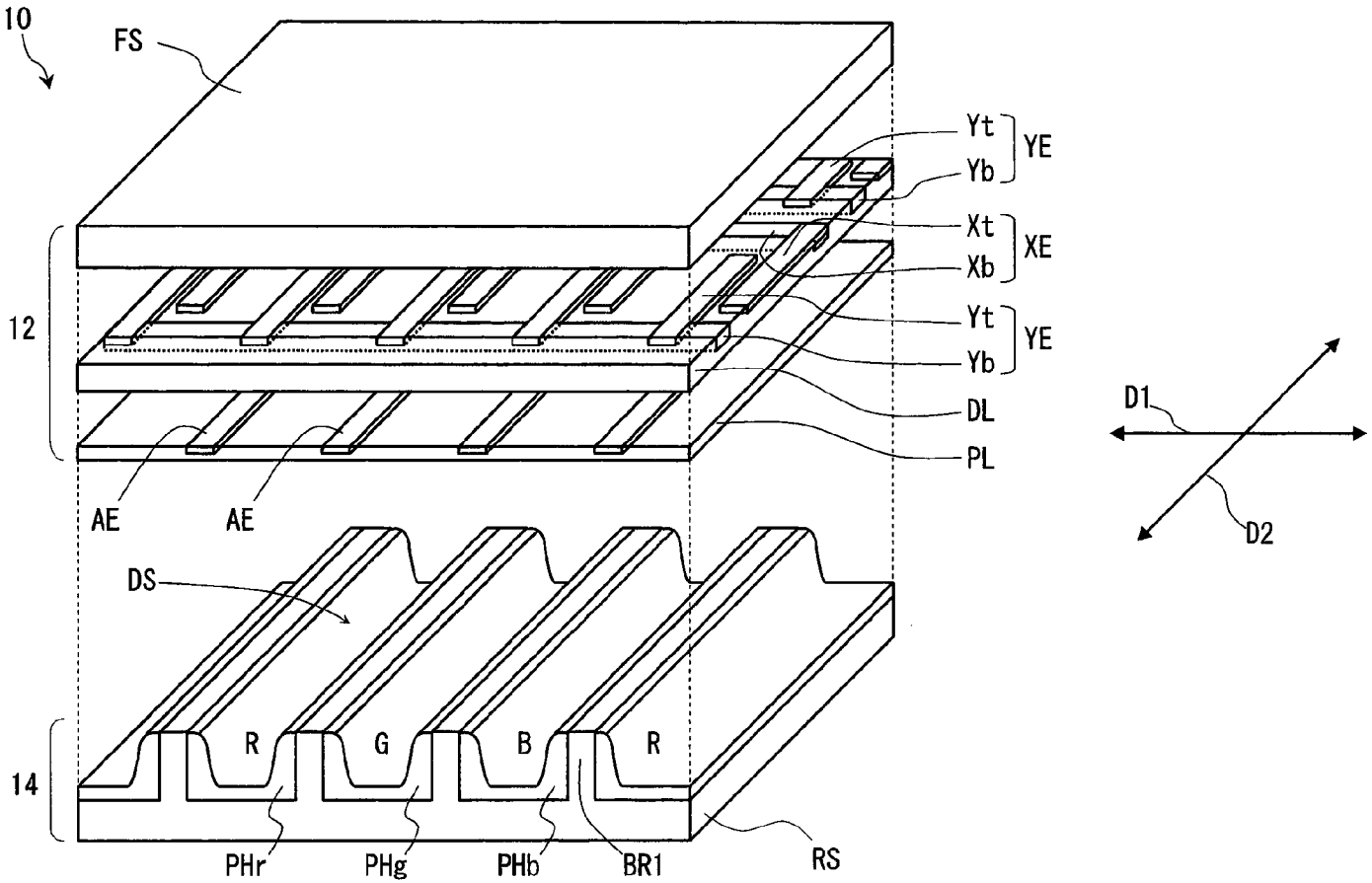
FIG. 6 is a view illustrating another modification example of the PDP illustrated in FIG. 1.

The example in which the barrier rib in the matrix state made up of the first barrier ribs BR1 and the second barrier ribs BR2 is integrally formed with the glass base RS is described, in the above-stated embodiments. The present invention is not limited to the embodiments. For example, the second barrier ribs BR2 are not formed, and a barrier rib in a stripe state made up by the barrier ribs BR1 may be integrally formed with the glass base RS as illustrated in FIG. 6. In this case, the cell is formed at an area surrounded by, for example, the bus electrodes Xb, Yb paired with each other and a pair of the first barrier ribs BR1 adjacent each other. The similar effect as the above-stated embodiments can be obtained also in this case. Besides, for example, the barrier ribs BR1, BR2 may be formed by coating a barrier rib material in a paste-state, passing through processes of a drying, a sand blast, a baking, or may be formed by a layer by printing. The similar effect as the above-stated embodiments can be obtained also in this case.

The many features and advantages of the embodiments are apparent from the detailed specification and, thus, it is intended by the appended claims to cover all such features and advantages of the embodiments that fall within the true spirit and scope thereof. Further, since numerous modifications and changes will readily occur to those skilled in the art, it is not desired to limit the inventive embodiments to exact construction and operation illustrated and described, and accordingly all suitable modifications and equivalents may be resorted to, falling within the scope thereof.

The invention claimed is:

1. A plasma display panel, comprising:

a first plate;

a second plate disposed to face the first plate via a discharge space and providing barrier ribs;

a plurality of first electrodes and a plurality of second electrodes provided on the first plate, extending in a first direction, and disposed to have intervals with one another;

a dielectric layer provided on the first plate and covering the first electrodes and the second electrodes;

a plurality of address electrodes provided on the dielectric layer, extending in a second direction intersecting with the first direction, and disposed to have intervals with one another; and a protective layer provided on the dielectric layer, covering the dielectric layer and the address electrodes, and exposing at least a part of the protective layer to the discharge space, wherein the address electrodes include a conductive layer formed by an alloy of aluminum and copper, the conductive layer not including a simple substance of copper.

2. The plasma display panel according to claim 1, wherein the address electrodes are made up of a single-layer film of the conductive layer.

3. The plasma display panel according to claim 1, wherein the address electrodes are made up of a two-layer film layered on the dielectric layer in a sequence of chromium and the conductive layer.

4. The plasma display panel according to claim 1, wherein the address electrodes are made up of a three-layer film layered on the dielectric layer in a sequence of chromium, the conductive layer and chromium.

5. The plasma display panel according to claim 1, wherein the protective layer is formed by magnesium oxide.

* * * * *

UNITED STATES PATENT AND TRADEMARK OFFICE

CERTIFICATE OF CORRECTION

PATENT NO. : 8,179,041 B2
APPLICATION NO. : 12/863679
DATED : May 15, 2012
INVENTOR(S) : Hideaki Yanagita et al.

It is certified that error appears in the above-identified patent and that said Letters Patent is hereby corrected as shown below:

Title Page;

At Section (73) the Assignee currently reads "Hitachi, Ltd., Tokyo (JP) ; Hitachi Plasma Display Limited, Miyazaki (JP)" but should read -- Hitachi, Ltd., Tokyo (JP) --

Signed and Sealed this
Fourteenth Day of May, 2013

Teresa Stanek Rea
*Acting Director of the United States Patent and Trademark Office*